US006295840B1

(12) United States Patent
Smith

(10) Patent No.: US 6,295,840 B1
(45) Date of Patent: Oct. 2, 2001

(54) PRESSURIZED LIQUID CRYOGEN PROCESS

(75) Inventor: Arthur Ramsden Smith, Telford, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/712,901

(22) Filed: Nov. 15, 2000

(51) Int. Cl.[7] ..... F25J 3/00
(52) U.S. Cl. ..... 62/654; 62/653; 62/648
(58) Field of Search ..... 62/643, 646, 654, 62/653, 648

(56) References Cited

U.S. PATENT DOCUMENTS

| | | | | |
|---|---|---|---|---|
| 2,777,296 | * | 1/1957 | Schilling | 62/654 |
| 3,688,513 | * | 9/1972 | Streich et al. | 62/654 |
| 4,852,357 | | 8/1989 | Porter | 62/50.4 |
| 5,136,852 | | 8/1992 | Neeser et al. | 62/50.4 |
| 5,341,646 | | 8/1994 | Agrawal et al. | 62/25 |
| 5,355,681 | | 10/1994 | Xu | 62/25 |
| 5,666,823 | | 9/1997 | Smith et al. | 62/646 |
| 5,884,488 | | 3/1999 | Gram et al. | 62/50.6 |
| 5,901,576 | | 5/1999 | Agrawal et al. | 62/646 |
| 5,907,959 | | 6/1999 | Agrawal et al. | 62/646 |
| 5,953,937 | * | 9/1999 | Corduan et al. | 62/646 |
| 5,956,973 | | 9/1999 | Herron et al. | 62/646 |
| 5,956,974 | | 9/1999 | Agrawal et al. | 62/646 |
| 5,966,967 | | 10/1999 | Agrawal et al. | 62/650 |
| 6,009,723 | | 1/2000 | Fidkowski et al. | 62/649 |
| 6,038,885 | | 3/2000 | Corduan et al. | 62/653 |

FOREIGN PATENT DOCUMENTS

| | | | |
|---|---|---|---|
| 0949473 | 10/1999 | (EP) | F25J/3/04 |
| WO97/04279 | 2/1997 | (WO) | F25J/3/04 |

* cited by examiner

*Primary Examiner*—William Doerrler
(74) *Attorney, Agent, or Firm*—John M. Fernbacher

(57) ABSTRACT

A cryogenic air separation process wherein one or more pressurized product streams enriched in oxygen, nitrogen and argon are produced by cryogenic distillation. One or more of the product streams are pressurized above the operating pressure of the distillation column by introducing a pressurizing fluid into a vessel containing a lower pressure product liquid. In the design of the system the pressurizing fluid can be air or streams enriched in oxygen, nitrogen or argon. Product stream pressurization is accomplished without the use of mechanical pumping devices.

20 Claims, 1 Drawing Sheet

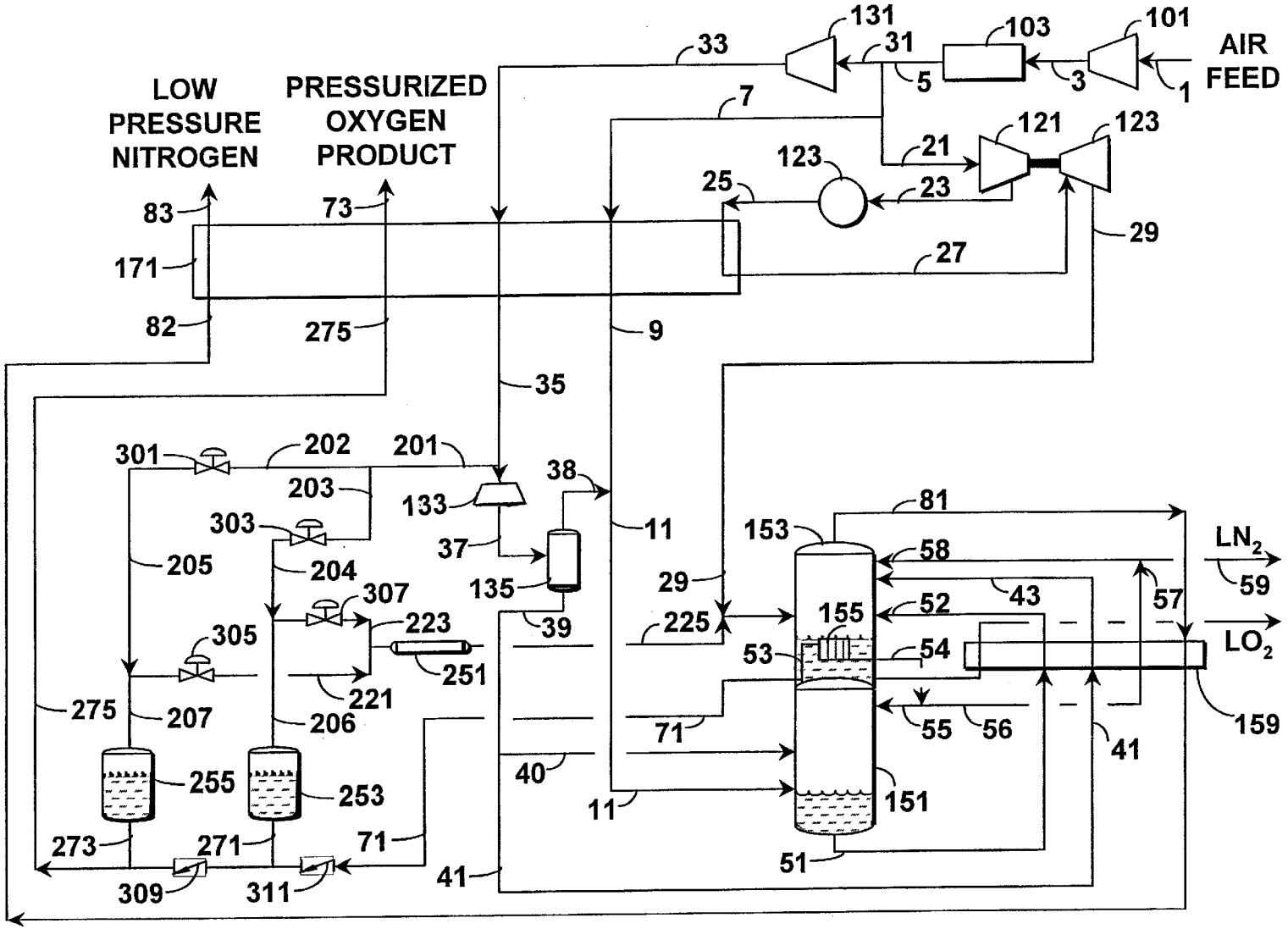
AIR FEED
PRESSURIZED OXYGEN PRODUCT
LOW PRESSURE NITROGEN
$LN_2$
$LO_2$

PRESSURIZED LIQUID CRYOGEN PROCESS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Cryogenic air separation processes separate pressurized air feed streams into individual product streams enriched in oxygen, nitrogen, and in some cases, argon. The cryogenic process is based on cooling the pressurized air feed streams to near or below their dew points, followed by separation in one or more distillation columns. A typical process involves separating a portion of nitrogen from the air feed streams in a first, higher pressure distillation column, followed by separation of oxygen from the remaining feed streams in a second, lower pressure distillation column. The higher pressure distillation column is normally operated slightly below the air feed pressure. The lower pressure distillation column operates at a pressure that allows liquid oxygen in the sump to be boiled against condensing, pressurized nitrogen from the overheads of the higher pressure distillation column, or condensing, pressurized air feed streams. The pressure ratio between the higher and lower pressure distillation columns is normally in the range of 2.5 to 5.0 to 1. The majority of cryogenic air separation plants currently in operation have lower pressure distillation columns operating at less than 10 psig, and higher pressure distillation columns operating at between 60 to 100 psig depending on the purity of the resulting product streams and specific equipment design parameters internal to the process.

In order to be distributed and usefully employed in downstream processes, the product streams are normally pressurized to levels well in excess of the operating pressure of the corresponding distillation column from which they are produced. A traditional method to accomplish product stream pressurization is to withdraw the product stream from the cryogenic process in the gaseous phase and compress it to the desired pressure. Compression equipment can utilize one or more stages, with or without cooling of the gas stream between stages of compression. Reciprocating, screw, centrifugal and axial compression equipment have been used to compress air separation process feed and product streams. Another method that has been employed to pressurize product streams to levels slightly elevated above the pressure of the distillation column from which they are produced involves the use of liquid head pressure. If a distillation column is elevated in relationship to heat exchange equipment to which it is connected, a liquid stream removed from the distillation column will be at a higher pressure at the connection to the inlet of the heat exchanger. The weight of the column of liquid between the heat exchanger and distillation column causes the increase in pressure at the inlet to the heat exchanger. The liquid product stream is then vaporized and warmed in the heat exchanger and delivered as a gaseous product stream at a pressure normally 1 to 10 psi higher in pressure than the pressure of corresponding distillation column from which it was produced.

Another means of increasing the pressure of a product stream from a cryogenic air separation process is by removing a liquid stream from the distillation columns, pumping the stream to higher pressure, and vaporizing and warming the pumped liquid stream in heat exchange equipment. These methods are typically described as pumped liquid or internal compression processes. The product streams can be any of the enriched streams produced as liquid within the cryogenic process and can be delivered at the desired pressure or further compressed to higher pressures before delivery. A common feature of these processes is the provision of fluids that can be heat exchanged against the pumped product streams in order to recover and return refrigeration back to the distillation system. The fluids used in the heat exchange process are often air or nitrogen streams that are often provided at pressures higher than the operating pressure of the main feed air streams or distillation column operating pressures from which they enter or from which they are produced. The fluids are normally higher in pressure than the pumped product streams they are heat exchanged against, but may be equal to or lower than the pressure of the pumped product streams, particularly when the product streams are near or above their critical points.

Pumps for pressurizing the liquid product streams may be of horizontal or vertical design and are typically driven with electric motors. Several pumps for the same service are often interconnected to allow for redundancy in the case of failure of one or more units. Because of the piping, valving, instrumentation and need to locate the motor drives at ambient environmental conditions, all of the foregoing equipment items are sometimes grouped together in a separate insulated enclosure, or pump box, separate from the distillation column systems. Liquid product lines to and from the pump box are interconnected to the distillation system and cryogenic heat exchange system via other insulated enclosures referred to as crossovers. Alternatively, and usually in the case of smaller production facilities, the liquid product pumps and their associated equipment may be contained in the bottom of the same insulated enclosure containing the distillation and/or heat exchange systems.

Pressurizing cryogenic liquids contained in storage tanks is normally accomplished by means of vaporizing a portion of the liquid inventory and admitting the resulting vapor into the tank's vapor head space. This method is thermodynamically inefficient for processes requiring liquid product, since a potion of the liquid is lost through vaporization. Another disadvantage occurs if the contents of the tank are to be quickly discharged or operated in a cyclic nature, due to the need for large vaporization equipment to quickly generate vapor to replace liquid inventory and maintain constant pressure.

U.S. Pat. No. 6,038,885 describes a pumped liquid process in which liquid product streams are removed from the distillation system, conveyed to an inventory accumulation tank, pumped to increase pressure, followed by vaporization and warming in the heat exchange system. In this example an air stream at the appropriate pressure is used to recover refrigeration from the pumped product streams. Also in this example, the use of at least two pumps are noted for pressurizing the product stream.

A mechanical pump design and its placement internally or externally to a cryogenic liquid storage vessel (liquefied natural gas) is disclosed in U.S. Pat. No. 5,884,488.

U.S. Pat. No. 5,666,823 describes a pumped liquid process in which an oxygen product stream and a separate nitrogen product stream are pumped to increase pressure prior to vaporization and warming. Higher pressure air and nitrogen streams, singly or in combination, are used to recover the refrigeration from the pumped product streams.

A triple distillation column, pumped liquid oxygen product process is disclosed in U.S. Pat. No. 5,341,646. In this process the pressure of the feed air is sufficient for use in recovering refrigeration from the pumped liquid oxygen stream.

U.S. Pat. No. 5,136,852 describes the prior art and an improvement for the pressure control of cryogenic liquid storage tanks. Both prior art and the invention require the input of heat into the system with subsequent loss of liquid inventory in order to control the pressure of the storage tank.

The non-mechanical pumping of a fluid from a vessel by generating gas pressure within the vessel is disclosed in U.S. Pat. No. 4,852,357. An electrical resistance heater is immersed in the vessel to vaporize liquid inventory to generate pressure within the gas head space of the vessel. The invention requires the input of heat into the system with subsequent loss of liquid inventory in order to control the pressure of the storage tank.

EP 0,949,473 A1 discloses the collection of liquid inventory within an air separation process for reintroduction to the column systems to shorten the time required to restart the air separation plant. Transfer of the liquids collected in a temporary holding tank to the distillation columns is accomplished by pressurizing the tank with a higher pressure gas. The liquids are pressurized to a level equal to the distillation column pressure plus liquid head pressure differences between the tank and column.

An air separation process incorporating mechanical pumps to provide varying amounts of pressurized oxygen and nitrogen products is described in WO 97/04279. Other representative pumped liquid air separation processes are described in U.S. Pat. Nos. 5,355,681; 5,901,576; 5,907,959; 5,956,973; 5,956,974; 5,966,967; and 6,009,723.

Pressurizing tanks containing liquid by introducing a higher pressure gas into the gas head space of a tank is known for transferring liquid on an intermittent flow basis. The use of gas pressurization for transferring liquid products on a continuous basis, however, combined with the efficient recovery of vented gas head space inventory into an air separation process, has not been recognized in the prior art as an efficient method to replace mechanical pumping systems. The invention disclosed below and defined by the claims which follow addresses the need for improved designs and methods of operation for pressurizing product streams internal to an air separation process.

BRIEF SUMMARY OF THE INVENTION

The invention is a method for the separation of air to provide at least one pressurized product enriched in a component of air, which method comprises:

(a) providing a pressurized, substantially contaminant-free air feed stream;

(b) cooling at least a portion of the contaminant-free air feed stream to provide a cooled air feed stream, and separating the cooled air feed stream in a cryogenic air separation system to provide an intermediate liquid product stream enriched in at least one of the components of air;

(c) introducing at least a portion of the intermediate liquid product stream into a vessel;

(d) pressurizing the vessel by introducing a pressurized fluid into the vessel;

(e) withdrawing from the vessel a pressurized liquid product enriched in one of the components of air; and (f) repeating (c), (d), and (e) in a cyclic manner.

The pressurized fluid can be a gas provided by compressing and cooling a portion of the contaminant-free air feed stream. A portion of the pressurized fluid can be reduced in pressure and introduced into the cryogenic air separation system. When a portion of the pressurized fluid is reduced in pressure, it can be partially condensed to form a vapor and a liquid, the liquid can be introduced into the cryogenic air separation system, and the vapor can provide the pressurized gas in (d).

The vapor displaced while introducing intermediate liquid product into the vessel can be reduced in pressure to provide a reduced-pressure vapor, and this reduced-pressure vapor can be returned to the cryogenic air separation system. If desired, the reduced-pressure vapor can be retained in a holding vessel before being returned to the cryogenic air separation system. The vapor withdrawn from the vessel can be reduced in pressure across a throttling valve or by work expansion through a turboexpander.

The invention can further comprise vaporizing the pressurized liquid product to provide a portion of the cooling required in (b) and yield a pressurized gaseous product stream. The pressurized gaseous product stream can be enriched in oxygen.

A portion of the substantially contaminant-free air feed stream can be compressed, cooled, work expanded, and introduced into the cryogenic air separation system.

In an alternative embodiment, the invention can further comprise:

(g) introducing a portion of the pressurized liquid product into an additional vessel;

(h) pressurizing the additional vessel by introducing additional pressurized fluid into the vessel;

(i) withdrawing from the additional vessel a pressurized liquid product enriched in one of the components of air; and (j) repeating (g), (h), and (i) in a cyclic manner.

In this alternative embodiment, (c), (d), and (e) would be carried out concurrently with (i) during a first time period; (g), (h), and (i) would be carried out concurrently with (e) during a second time period; and the first and second time periods would be repeated in a cyclic manner.

The vapor displaced while introducing intermediate liquid product into the additional vessel can be reduced in pressure to provide an additional reduced-pressure vapor, and the additional reduced-pressure vapor can be returned to the cryogenic air separation system. The additional reduced-pressure vapor can be retained in a holding vessel before being returned to the cryogenic air separation system.

The vapor withdrawn from the additional vessel can be reduced in pressure across a throttling valve or by work expansion through a turboexpander.

The invention can further comprise vaporizing the pressurized liquid product to provide a portion of the cooling required in (b) and yield a pressurized gaseous product stream. The pressurized gaseous product stream can be enriched in oxygen or can be enriched in nitrogen.

BRIEF DESCRIPTION OF THE DRAWING

The single FIGURE is a schematic process flowsheet for an embodiment of the present invention that permits a continuous supply of a pressurized product stream.

DETAILED DESCRIPTION OF THE INVENTION

The invention is a method of producing one or more product streams from a cryogenic air separation process at pressures greater than the distillation systems from which they originate. The system uses pressurizing fluids to accomplish the product stream pressurization and eliminates the mechanical product pumps typically required for product pressurization. The invention reduces the capital cost and maintenance cost of the air separation facility by eliminating the expensive and power-consuming pumps which require maintenance and periodic replacement, and which can be the source of unit shutdowns as a result of their failure. The invention is also useful when the air separation process is installed in a location that cannot tolerate the loss of cryogenic fluids from the air separation process. Such installations include shipboard, barge or platform locations.

An embodiment of the invention is illustrated in the Figure, wherein a pressurized oxygen product stream is produced on an essentially continuous basis using a pressurizing fluid provided by clean, carbon dioxide-free, dry air or by other streams within the air separation process.

Ambient air feed in line 1 is pressurized in compressor 101 to between 50 and 400 psia. The pressurized air stream in line 3 is processed in unit 103 to remove contaminants such as water, carbon dioxide and hydrocarbons that would freeze out or pose safety risks in the operation of the air separation process. This air stream is therefore substantially contaminant-free, which means that contaminants have been removed to levels which eliminate any freezing or safety problems in the downstream air separation system.

Treated, pressurized air in line 5 is split into three parts. The largest portion, in line 7, flows to heat exchange system 171 where it is cooled to cryogenic temperature prior to entering the higher pressure distillation column 151. A second portion of treated, pressurized air in line 5 is withdrawn via line 21 and enters compressor 121 which is linked to expander 123. Air in line 21 is compressed and exits compressor 121 in line 23. The hot, compressed air is cooled in heat exchanger 123 to yield cooled compressed air in line 25. The air in line 25 is cooled in heat exchange system 171, exiting at a midpoint location as cooled air in line 27. Cooled air in line 27 is work expanded in expander 123, which reduces its pressure and temperature. Cold, reduced pressure air in line 29 enters lower pressure distillation column 153. The shaft work generated by the expansion of air from line 27 is used to drive compressor 121 as previously described.

A third portion of treated, pressurized air is taken via line 31 and compressed in compressor 131 to yield further compressed air in line 33. The pressure of the air in line 33 is selected based on the desired pressure of the oxygen product in line 73 (described later). The pressure of the air in line 33 must, at a minimum, permit recovery of the refrigeration contained in product streams entering the heat exchange system 171 and maintain a workable temperature approach between cooling and warming streams within heat exchange system 171. Compressed air in line 33 is cooled in heat exchanger 171 to yield cooled air in line 35. The air in line 35 can be work expanded in turboexpander 133 to produce additional refrigeration.

The pressurizing fluid must be available at a pressure above the desired pressure of the final pressurized liquid. When the pressurizing fluid has a different composition than the liquid being pressurized, the pressurizing fluid preferably is a gas, and preferably little or none of the pressurizing gas is condensed during the pressurizing process. If the composition of the pressurizing fluid is close to the composition of the liquid being pressurized, the pressurizing fluid can be a mixture of gas and liquid.

Expanded fluid in line 37 can be separated in phase separator 135 to yield a gaseous stream in line 38 which is combined with the air feed stream in line 9. Liquid in line 39 from separator 135 is split and a portion flows through line 40 which enters higher pressure distillation column 151. The remaining portion flows through line 41 to subcoller 159. Subcooled liquid is withdrawn therefrom via line 43 and enters the lower pressure distillation column 153.

The feed streams entering the higher pressure distillation column 151 become enriched in nitrogen as they flow upward through the column. The operating pressure of distillation column 151 is set by the pressure of air feed stream 3, less pressure drop through losses in the system. A nitrogen enriched stream is removed via line 53 as vapor from the top of distillation column 151 and flows to reboiler-condenser 155 which is located in the sump of lower pressure distillation column 153. Nitrogen vapor is condensed in the reboiler-condenser and is withdrawn via line 54. Refrigeration to condense the nitrogen is generated by boiling liquid oxygen which is produced in the bottom section of distillation column 153. Liquid nitrogen in line 54 is split into a stream vial line 55 which is used to reflux the higher pressure distillation column 151, with the remainder stream flowing via line 56 to subcooler 159. Subcooled liquid nitrogen in line 57 is split into a first portion which flows via line 59 to an external storage system and a second portion via line 58 which is used to reflux the lower pressure distillation column 153.

The liquid accumulating in the sump of higher pressure distillation column 151 is enriched in oxygen and is withdrawn via line 51. The stream in line 51 is subcooled in subcooler 159 and flows via line 52 into the lower pressure distillation column 153. Feed streams entering the lower pressure distillation column 153 also become enriched in nitrogen as they flow upward through the column, while the oxygen product stream accumulates in the sump. The operating pressure of lower pressure distillation column 153 is set by vapor-liquid equilibrium conditions that allow reboiler-condenser 155 to operate with a positive temperature difference between condensing nitrogen enriched and boiling oxygen enriched streams. An enriched nitrogen stream is removed from the top of the lower pressure column 153 via line 81, is warmed in subcooler 159, and flows via line 82 to heat exchange system 171, where it provides refrigeration to partially cool the air feed streams in lines 7 and 33.

Liquid oxygen is withdrawn via line 71 from the sump of distillation column 153, flows through open check valve 311 and line 271, and accumulates in vessel 253. Check valve 309 remains closed because the pressure in line 275 is significantly higher than the pressure in lines 71 or 271. Valve 303 is closed and valve 307 is open to allow vapor displaced from vessel 253 to flow back to distillation column 153 via line 223, tank 251, and line 225. Pressurized product from previously pressurized vessel 255 exits via line 273 to yield a pressurized oxygen product stream in line 275. Valve 305 is closed, while valve 301 is open to admit pressurizing gas and control the pressure of the oxygen product in line 275. A portion of cold, pressurized fluid is withdrawn from line 35 through line 201, and provides pressurization fluid via lines 202 and 203. Valve 301 throttles the pressure to yield gas via lines 205 and 207 to replace the head space fluid and maintain the pressure in vessel 255 as pressurized liquid product is withdrawn therefrom.

Prior to refilling vessel 255, the contents of vessel 253 must be pressurized. This is accomplished by closing valve 307 and opening valve 303 under pressure control. Check valve 311 closes and liquid flow in line 71 is temporarily stopped, allowing liquid inventory to briefly accumulate in the sump of distillation column 153. When the pressure in vessel 253 is greater than vessel 255, valve 301 is closed and valve 305 is opened under pressure control. Pressure in vessel 253 is further increased by control of valve 303 and fluid flow via lines 203, 204, and 206, and the majority of the liquid is transferred to vessel 255 via line 273. Liquid product continues to flow through line 275 during this process, although flow is switched from line 273 to line 271 during the transfer operation. Displaced vapor from vessel 255 is returned to distillation column 153 through control valve 305, line 221, surge tank 251, and line 225.

When the liquid content of vessel 253 is nearly depleted, valve 303 is closed and valve 307 opens to equalize the pressure between the vessel and distillation column 153. Check valve 309 closes and check valve 311 opens allowing liquid from distillation column 153 to flow to vessel 253 via line 71. In the meantime, valve 305 has closed and valve 301 is open under pressure control to supply liquid product via lines 273 and 275. Thus an essentially constant flow of final oxygen product gas is provided via line 73 by the cyclic operation of liquid vessels 253 and 255.

In an alternative embodiment of the invention, air in line 33 is split into two streams (not shown) before entering heat exchange system 171. These two streams are cooled to different temperatures to allow optimizing the operation and efficiency of the process. One of the streams is used as the pressurizing gas for pressurizing liquid in vessels 253 and 255 and the other is work expanded in expander 133 as earlier described.

In another alternative embodiment of the invention, the source of the pressurizing fluid is provided by gas from line 38 via line 201 (not shown). Expander 133 reduces the pressure of stream 35 to a level slightly above the pressure required for the pressurized product stream in line 275. Vapor leaves separator 135 via line 38 following expansion of the high pressure air stream 35. Alternatively, expander 133 could be replaced by a throttling valve if recovery of the energy available from the pressure reduction is not economically attractive. Optionally, additional fluid expanders could be used to recover the pressure energy by reducing the pressures of the gas in lines 40 and 41 to the operating pressures of their respective distillation column feed requirements.

In order to reduce the plot area of the cryogenic equipment, vessels 253 and 255 could be stacked. The two vessels could be configured as is practiced with high and low pressure distillation column designs, using a single shell with an intermediate head to separate the contents of the two vessels. Vessels such as 253 and 255 can also be incorporated into the shell of the distillation columns at appropriate elevations. Vessels such as 253 and 255 could also be incorporated in a center annular area that is often incorporated into the design of certain types of distillation columns employing trays or packing.

Under some operating circumstances, it may be necessary to produce slightly purer product in the sump of distillation column 153 than required in line 275 in order to account for the condensation of air or nitrogen in pressurized product vessels 253 and 255 as the pressure changes during cyclic operation. Depending upon the mixing characteristics of the filling operation, a method to mix the contents of the product vessels may be required. Such methods could include a perforated diptube device, introduction of liquid in line 71 to vessel 253 via a separate top connection, or other methods and internal devices to overcome concentration differences in the vessels.

An alternative embodiment of the invention can be used when a continuous flow of final product in line 275 is not required. This embodiment uses a simplified system in which product storage vessel 255, valves 301 and 305, and lines 202, 205, 207, 221, and 273 are not required. In this alternative, product flow through line 275 is temporarily terminated while liquid is transferred from the sump of lower pressure column 153 to vessel 253 via lines 71 and 271 with check valve 311 in the open position. Check valve 309 is held closed by residual higher pressure in line 275. Liquid in vessel 253 is pressurized by gas via line 203, valve 303, line 204, and line 206 as earlier described. When the pressure in vessel 253 reaches the pressure in line 275, pressurized liquid begins to flow via line 271, check valve 309, and line 275. Check valve 311 closes as the pressure in vessel 253 exceeds the pressure in the sump of lower pressure column 153, and a liquid inventory builds up in the sump.

When the liquid in vessel 253 is exhausted, valve 303 is closed, valve 307 is opened, and accumulated liquid flows from the sump via line 71, check valve 311, and line 271 into vessel 253. Check valve 309 is closed by virtue of the pressure difference in lines 275 and 271. When vessel 253 is full, the process is repeated.

While the pressurized product in the embodiment of the invention described above is oxygen from the lower pressure column, any liquid product stream formed in the cryogenic air separation system can be pressurized by the method described. For example, liquid nitrogen in line 56 could be pressurized by this method and vaporized to provide a high pressure nitrogen gas product.

While a specific double column cryogenic air separation system is utilized in the embodiment described above, any type of cryogenic air separation system which generates a liquid product can be used in the present invention. For example, a single column system could be used. Alternative gas streams from the air separation system could be compressed and used to pressurize vessels 253 and 255. For example, compressed nitrogen could be used in place of air in line 33. Compressed nitrogen for this purpose could be obtained from compressed nitrogen which is used in a liquefaction process added to the basic air separation process.

Thus the present invention provides a method of producing one or more pressurized product streams enriched in oxygen, nitrogen or argon, from a cryogenic air separation process without the need of mechanical pumping devices. Elimination of mechanical pumps reduces capital and operating costs, improves reliability and is particularly useful for locations where loss of cryogenic liquid inventory can not be tolerated, such as shipboard-, platform-, or barge-mounted installations. A potential cost benefit can be realized by the elimination of the pumps, motors, or other drive mechanisms, piping, instruments, and associated equipment such as separate insulated enclosures. The ability to provide internally pressurized product streams from a single insulated enclosure without the need to interconnect cryogenic lines transporting liquid products to other parts of the system could benefit specific unit locations such as shipboard-, barge-, or offshore platform-mounted cryogenic plants that would be adversely impacted by a failure resulting in loss of liquid inventory from the insulated enclosure or interconnecting piping systems.

The invention also provides flexibility in the selection of any of several available pressurizing fluid streams including; feed air streams, nitrogen, oxygen or argon enriched streams at various pressure levels in the process, or air, nitrogen, oxygen, argon enriched streams which have been warm or cold compressed.

The essential characteristics of the present invention are described completely in the foregoing disclosure. One skilled in the art can understand the invention and make various modifications without departing from the basic spirit of the invention, and without deviating from the scope and equivalents of the claims which follow.

What is claimed is:

1. A method for the separation of air to provide at least one pressurized product enriched in a component of air, which method comprises:

(a) providing a pressurized, substantially contaminant-free air feed stream;

(b) cooling at least a portion of the contaminant-free air feed stream to provide a cooled air feed stream, and separating the cooled air feed stream in a cryogenic air separation system to provide an intermediate liquid product stream enriched in at least one of the components of air;

(c) introducing at least a portion of the intermediate liquid product stream into a vessel;

(d) pressurizing the vessel by introducing a pressurized fluid into the vessel;

(e) withdrawing from the vessel a pressurized liquid product enriched in one of the components of air; and (f) repeating (c), (d), and (e) in a cyclic manner.

2. The method of claim 1 wherein the pressurized fluid is a gas provided by compressing and cooling a portion of the contaminant-free air feed stream.

3. The method of claim 1 wherein vapor displaced while introducing intermediate liquid product into the vessel is reduced in pressure to provide a reduced-pressure vapor, and the reduced-pressure vapor is returned to the cryogenic air separation system.

4. The method of claim 3 wherein the reduced-pressure vapor is retained in a holding vessel before being returned to the cryogenic air separation system.

5. The method of claim 3 wherein the vapor withdrawn from the vessel is reduced in pressure across a throttling valve.

6. The method of claim 3 wherein the vapor withdrawn from the vessel is reduced in pressure by work expansion through a turboexpander.

7. The method of claim 1 which further comprises vaporizing the pressurized liquid product to provide a portion of the cooling required in (b) and yield a pressurized gaseous product stream.

8. The method of claim 7 wherein the pressurized gaseous product stream is enriched in oxygen.

9. The method of claim 1 wherein a portion of the substantially contaminant-free air feed stream is compressed, cooled, work expanded, and introduced into the cryogenic air separation system.

10. The method of claim 1 which further comprises (g) introducing a portion of the pressurized liquid product into an additional vessel;

(h) pressurizing the additional vessel by introducing additional pressurized fluid into the vessel;

(i) withdrawing from the additional vessel a pressurized liquid product enriched in one of the components of air; and (j) repeating (g), (h), and (i) in a cyclic manner.

11. The method of claim 10 wherein (c), (d), and (e) are carried out concurrently with (i) during a first time period; (g), (h), and (i) are carried out concurrently with (e) during a second time period; and the first and second time periods are repeated in a cyclic manner.

12. The method of claim 10 wherein vapor displaced while introducing intermediate liquid product into the additional vessel is reduced in pressure to provide an additional reduced-pressure vapor, and the additional reduced-pressure vapor is returned to the cryogenic air separation system.

13. The method of claim 12 wherein the additional reduced-pressure vapor is retained in a holding vessel before being returned to the cryogenic air separation system.

14. The method of claim 12 wherein the vapor withdrawn from the additional vessel is reduced in pressure across a throttling valve.

15. The method of claim 12 wherein the vapor withdrawn from the additional vessel is reduced in pressure by work expansion through a turboexpander.

16. The method of claim 10 which further comprises vaporizing the pressurized liquid product to provide a portion of the cooling required in (b) and yield a pressurized gaseous product stream.

17. The method of claim 16 wherein the pressurized gaseous product stream is enriched in oxygen.

18. The method of claim 16 wherein the pressurized gaseous product stream is enriched in nitrogen.

19. The method of claim 2 wherein a portion of the pressurized fluid is reduced in pressure and introduced into the cryogenic air separation system.

20. The method of claim 2 wherein a portion of the pressurized fluid is reduced in pressure and partially condensed to form a vapor and a liquid, the liquid is introduced into the cryogenic air separation system, and the vapor provides the pressurized gas in (d).

* * * * *